US011417964B2

(12) United States Patent
Zhang et al.

(10) Patent No.: US 11,417,964 B2
(45) Date of Patent: Aug. 16, 2022

(54) SINGLE POLARIZED ARRAY WAVEGUIDE ANTENNA

(71) Applicant: Universal Microwave Technology, Inc., Keelung (TW)

(72) Inventors: Ting-Rui Zhang, Yilan County (TW); Yu-Cheng Chen, Taipei (TW); Li-Ching Lin, Taoyuan (TW); Sheng-Feng Yeh, New Taipei (TW); Chia-Hao Hsu, Keelung (TW); Tung-Yi Wu, Keelung (TW)

( * ) Notice: Subject to any disclaimer, the term of this patent is extended or adjusted under 35 U.S.C. 154(b) by 31 days.

(21) Appl. No.: 17/138,931

(22) Filed: Dec. 31, 2020

(65) Prior Publication Data

US 2022/0209419 A1 Jun. 30, 2022

(51) Int. Cl.

| | |
|---|---|
| ***H01Q 21/00*** | (2006.01) |
| ***H01Q 21/06*** | (2006.01) |
| ***H01Q 1/24*** | (2006.01) |
| ***H01Q 1/02*** | (2006.01) |
| ***H01Q 13/00*** | (2006.01) |
| ***H01Q 5/55*** | (2015.01) |

(52) U.S. Cl.

CPC ..... *H01Q 21/0031* (2013.01); *H01Q 1/02* (2013.01); *H01Q 1/241* (2013.01); *H01Q 5/55* (2015.01); *H01Q 13/00* (2013.01); *H01Q 21/061* (2013.01)

(58) Field of Classification Search

CPC ..... H01Q 1/02; H01Q 1/241; H01Q 13/00; H01Q 21/0031; H01Q 21/061

See application file for complete search history.

(56) References Cited

U.S. PATENT DOCUMENTS

2015/0188238 A1* 7/2015 Oppenlaender ..... H01Q 19/08 343/756

FOREIGN PATENT DOCUMENTS

WO WO-2020187983 A1 * 9/2020 ..... H01P 5/024

* cited by examiner

*Primary Examiner* — Andrea Lindgren Baltzell
*Assistant Examiner* — Amal Patel

(57) ABSTRACT

The present invention discloses a new single polarized array waveguide antenna adapted to be configured above a signal processing substrate, and including an antenna array substrate and a waveguide body. The antenna array substrate includes a plurality of antenna units, each of which having a coupling portion and an impedance matching portion. The waveguide body is configured above the antenna array substrate, and includes a plurality of waveguide channels passing through the waveguide body. Each waveguide channel has a first ridge and a second ridge projecting from wall surfaces and arranged opposite to each other. The first ridge has a first lower withdrawn edge on a lower section of the waveguide channel, and the second ridge has a second lower withdrawn edge on the lower section of the waveguide channel. The first lower withdrawn edge is distanced from the antenna array substrate by a first matching height, and the second lower withdrawn edge is distanced from the antenna array substrate by a second matching height, wherein the first matching height is different from the second matching height. Accordingly, signal transmission quality is improved by the structural arrangement above.

10 Claims, 5 Drawing Sheets

SINGLE POLARIZED ARRAY WAVEGUIDE ANTENNA

BACKGROUND OF THE INVENTION

Field of the Invention

The present invention relates to an array antenna having a waveguide, and more particularly to a new single polarized array waveguide antenna.

Description of the Prior Art

Antennas are an important device in wireless communication equipment. Antennas allow signals to be converted into electromagnetic energy released into free space, and are also capable of receiving electromagnetic waves from free space.

In current mobile communication technologies, demands for transmission rates and bandwidths are constantly increasing, such that carrier wavelengths used by mobile communication technologies have entered short wavebands with sufficient bandwidths. For example, transmission techniques of the 5th Generation (5G) Mobile Networks use millimeter waves with a frequency exceeding 6 GHz, and may even proceed to use of millimeter waves of 26.5 GHz to 300 GHz.

However, as the wavelength of a carrier gets shorter, the attenuation level of electromagnetic wave energy becomes faster as the transmission distance in air increases. Thus, a deployment that uses an antenna array is adopted for configuring an antenna device so as to centralize the energy of electromagnetic waves. In an antenna array, the distance between individual antenna units needs to be less than or equal to the length of half wavelength of carriers used, in a way that these antenna are necessarily closely arranged, leading extreme difficulties in further enhancing signal transmission quality.

SUMMARY OF THE INVENTION

It is an object of the present invention to enhance signal transmission quality.

It is another object of the present invention to provide an array waveguide antenna with low transmission loss with respect to transmission of short-wavelength carriers.

It is another object of the present invention to provide an array waveguide antenna with better impedance matching and improved bandwidths.

It is yet another object of the present invention to provide an array waveguide antenna with a better heat dissipation capability.

To achieve the above and other objects, a new single polarized array waveguide antenna is provided according to an embodiment of the present invention. The new single polarized array waveguide antenna is adapted to be configured above a signal processing substrate, and includes an antenna array substrate and a waveguide body. The antenna array substrate includes a plurality of antenna units, each of which having a coupling portion and an impedance matching portion. The waveguide body is configured above the antenna array substrate, and includes a plurality of waveguide channels passing through the waveguide body. Each of the waveguide channels has a first ridge and a second ridge projecting from wall surfaces and arranged opposite to each other. The first ridge has a first lower withdrawn edge on a lower section of the waveguide channel, the second ridge has a second lower withdrawn edge on the lower section of the waveguide channel. The first lower withdrawn section is distanced from the antenna array substrate by a first matching height, and the second lower withdrawn edge is distanced from the antenna array substrate by a second matching height, wherein the first matching height is different from the second matching height.

According to an embodiment of the present invention, the first ridge is closer to the coupling portion than the second ridge, and the first matching height may be more than the second matching height.

According to an embodiment of the present invention, the impedance matching portion is closer to a middle part of the antenna unit than the coupling portion.

According to an embodiment of the present invention, each of the antenna units is a conductive sheet, and the impedance matching portion may be a matching hole passing through the antenna units and be located at the center of the conductive sheet.

According to an embodiment of the present invention, the coupling portion may be coupled to a signal feed portion of the signal processing substrate.

According to an embodiment of the present invention, the projecting direction of the first ridge and the second ridge may be a polarization direction of electromagnetic signals transmitted, and the position of the electromagnetic signal at a signal feed point on the antenna unit is closer to the first ridge than the second ridge.

According to an embodiment of the present invention, two neighboring ridges between two neighboring waveguide channels may be the same first ridge or the same second ridge.

According to an embodiment of the present invention, each of the waveguide channels may be a rectangle in shape, and each first ridge and each second ridge project from wall surfaces of opposite sides of the rectangle.

According to an embodiment of the present invention, the first ridge may has a first upper withdrawn edge on an upper section of the waveguide channel, and the second ridge may has a second withdrawn edge on the upper section of the waveguide channel.

According to an embodiment of the present invention, the antenna array substrate may further comprise a heat dissipation lattice layer, the heat dissipation lattice layer is coupled to a plurality of heat conducting units passing through the antenna array substrates, and each of the heat conducting units is coupled to a grounding layer of the signal processing substrate.

According to an embodiment of the present invention, each of the antenna units may be surrounded by the heat dissipation lattice layer.

According to an embodiment of the present invention, the waveguide body, the heat dissipation lattice layer and the heat conducting units may be formed of metal materials.

Thus, the new single polarized array waveguide antenna according to the embodiments of the present invention provides, based on the structural arrangement of the waveguide body, better waveguide matching, reduces transmission loss, and facilitates electromagnetic wave energy to be fed from the antenna substrate into the waveguide body and be emitted from the waveguide body, further helping to increase the bandwidth and providing better beamforming effects. Moreover, by using a heat dissipation lattice layer and a plurality of heat conducting units, the antenna array in a dense arrangement is provided with a better heat dissipation solution.

DESCRIPTION OF THE PREFERRED EMBODIMENTS

The technical characteristics, contents, advantages and effects of the present invention will become apparent from the following detailed description taken with the accompanying drawing.

For energy of electromagnetic waves emitted from an array antenna, the beamforming effect of the electromagnetic waves can be further achieved using a waveguide structure. However, the waveguide structure needs to be correspondingly reduced when the wavelength of the transmitted electromagnetic waves gets shorter, such that the shape of a feed point between the waveguide structure and the array antenna becomes extremely critical.

The waveguide structure described in the following embodiments achieves waveguide matching between array antennas by means of an arrangement of ridges, so that waveguide energy can be smoothly emitted. Further, the arrangement of ridges also allows a distance used between waveguide channels to be further shortened (e.g., shorter than 5 mm), while achieving better beamforming effects and increased bandwidths.

Figure 1:
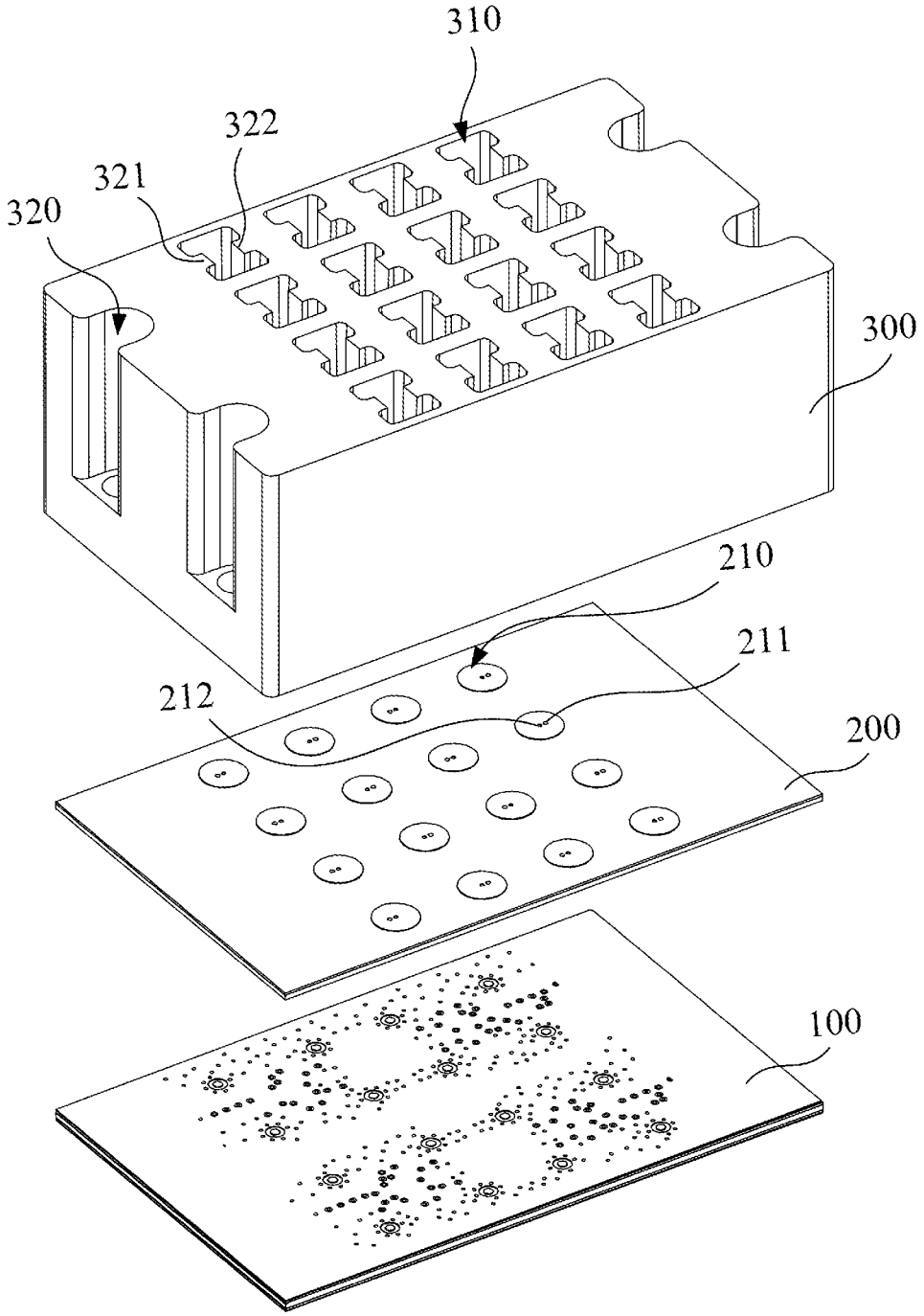
FIG. 1 is an exploded schematic diagram of a new single polarized array waveguide antenna and a signal processing substrate according to an embodiment of the present invention.

FIG. 1 shows an exploded schematic diagram of a new single polarized array waveguide antenna and a signal processing substrate according to an embodiment of the present invention. The new single polarized array waveguide antenna includes an antenna array substrate 200 and a waveguide body 300, and is configured above a signal processing substrate 100. It should be noted that, another layer may be or may be not configured between the new single polarized array waveguide antenna and the signal processing substrate 100, and between the antenna array substrate 200 and the waveguide body 300; in this embodiment, an example without other layers in between is described.

The antenna array substrate 200 of the new single polarized array waveguide antenna is capable of feeding via the antenna units 210 signals transmitted by the signal processing substrate 100 to waveguide channels 310 of the waveguide body 300, further emitting the electromagnetic wave energy into the air via the waveguide channels 310. An example of a 4×4 antenna array is shown in FIG. 1, and the waveguide body 200 is provided with waveguide channels 310 corresponding to the number of the antenna units 210.

Each antenna unit 210 has a coupling portion 211 and an impedance matching portion 212. The coupling portion 211 may be coupled to a connection point in the signal processing substrate 100. For example, both the antenna array substrate 200 and the signal processing substrate 100 may be printed circuit boards (PCB); in these substrates, coupling requirements of various circuit signals and grounding points may be achieved by means of layered structures, thus forming various transmission paths in the layered structures. Below the signal processing substrate 100, an integrated circuit (IC) may be configured to perform tasks including packet processing and conversion, and to establish the transmission paths using the layered structures and conduction paths so as to further transmit signals to the corresponding coupling portion 211.

The antenna array substrate 200 is frequently used as a transmission interface for emitting electromagnetic wave energy into the air. However, in the embodiment of the present invention, using the arrangement of the special structural design in the waveguide body 300, waveguide matching is enhanced while transmission loss is reduced, further increasing bandwidths and providing better beamforming effects under the use of the waveguide body 300. The waveguide body 300 is formed of a metal material, and is fixed above the antenna array substrate 200 and the signal processing substrate 100 by means of a fixing portion 320 in collaboration with a fixing element (not shown). The waveguide body 300 may further provide a heat dissipation ability, and effectively achieves a heat dissipation effect for the integrated circuit below the signal processing substrate 100 through the heat conductivity of the metal material.

Figure 2:
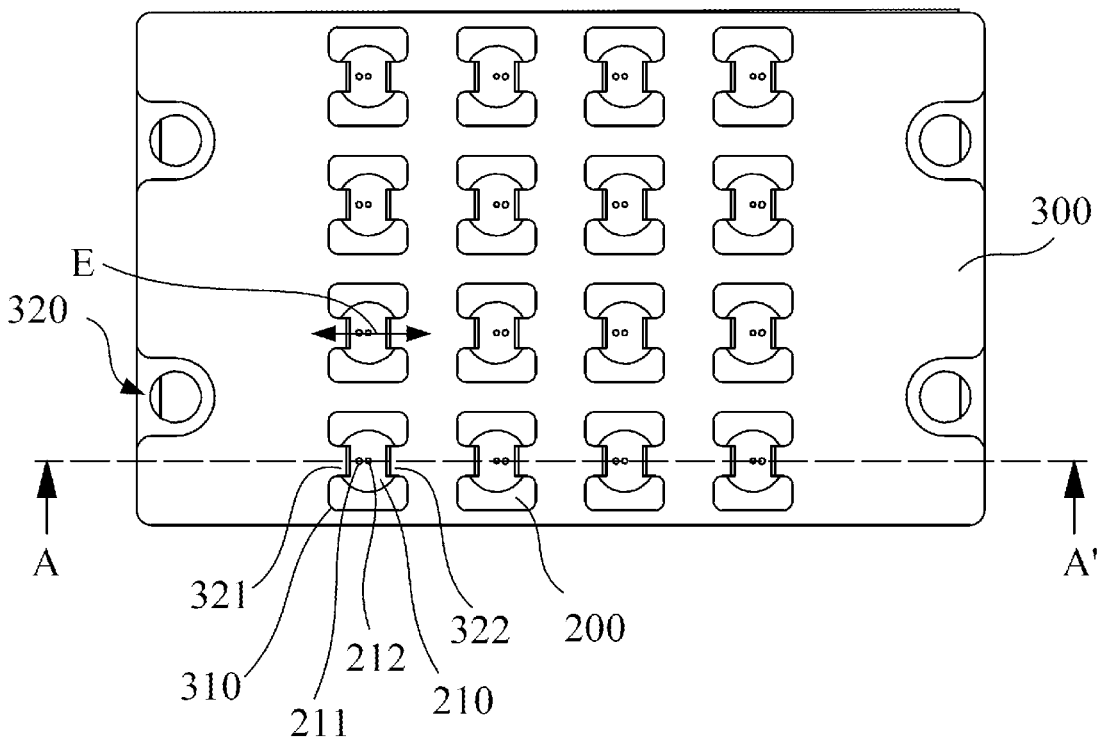
FIG. 2 is a schematic diagram in a top view of FIG. 1.

Referring to FIG. 1 and FIG. 2, FIG. 2 shows a schematic diagram in a top view of FIG. 1. Each waveguide 310 passing through the waveguide body 300 has a first ridge 321 and a second ridge 322 projecting from channel wall surfaces and disposed opposite to each other. The waveguide channel 310 is a rectangle in shape in this embodiment, and channels in other shapes are also applicable. In this embodiment, each first ridge 321 and each second ridge 322 respectively project from wall surfaces of opposite sides of the rectangle. The projection directions of the first ridge 321 and the second ridge 322 are a polarization direction of the electromagnetic waves transmitted in the waveguide channel 310, that is, a vibration direction E of the electric field.

As shown in FIG. 2, the impedance matching portion 212 may be configured to be closer to the middle part of the antenna unit 210 than the coupling portion 211. In other words, with respect to the antenna unit 210, the coupling portion 211 may be configured on an eccentric position. The position of the coupling portion 211 is associated with the shape features of the first ridge 321 and the second ridge 322 at lower portions of the waveguide channel 310.

Figure 3:
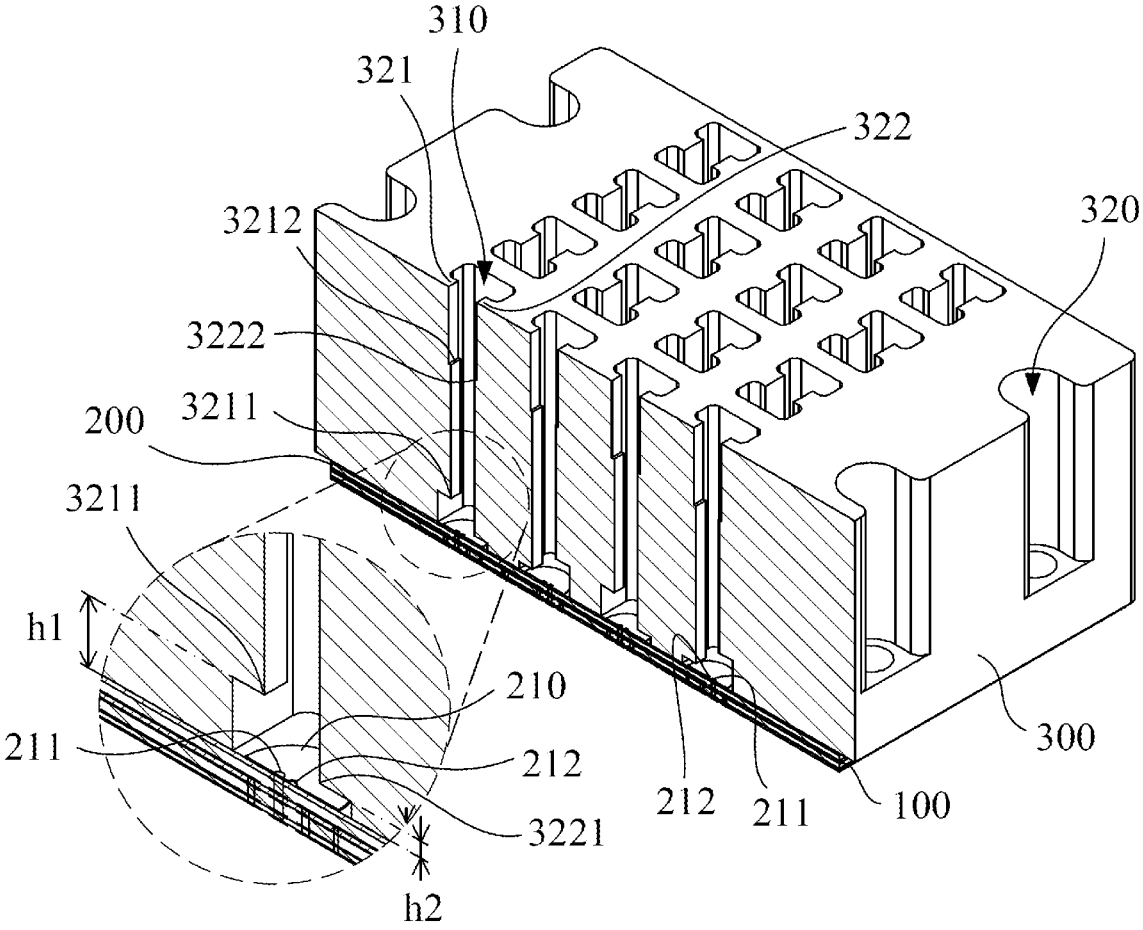
FIG. 3 is a three-dimensional section schematic diagram along a section line AA' in FIG. 2.

Referring to FIG. 2 and FIG. 3, FIG. 3 shows a three-dimensional section schematic diagram along a section line AA' in FIG. 2. As shown in FIG. 3, the first ridge 321 is located on a lower section of the waveguide channel 310, and has a first lower withdrawn edge 3211. The second ridge 322 is located on the lower section of the waveguide channel 310, and has a second lower withdrawn edge 3221. These withdrawn edges mean that the projecting ridges are withdrawn in reverse directions towards the wall surfaces of the waveguide channel 310. Under processing cost considerations, the withdrawn parts may adopt a right-angle cutting method as exemplified in FIG. 3, such that a position at the withdrawn edge has a cross section and is directly withdrawn to the original wall surface of the waveguide channel 310. In other embodiments, gradual withdrawal methods or other methods such as steps or inclined surfaces may also be used to form the withdrawn parts.

Figure 4:
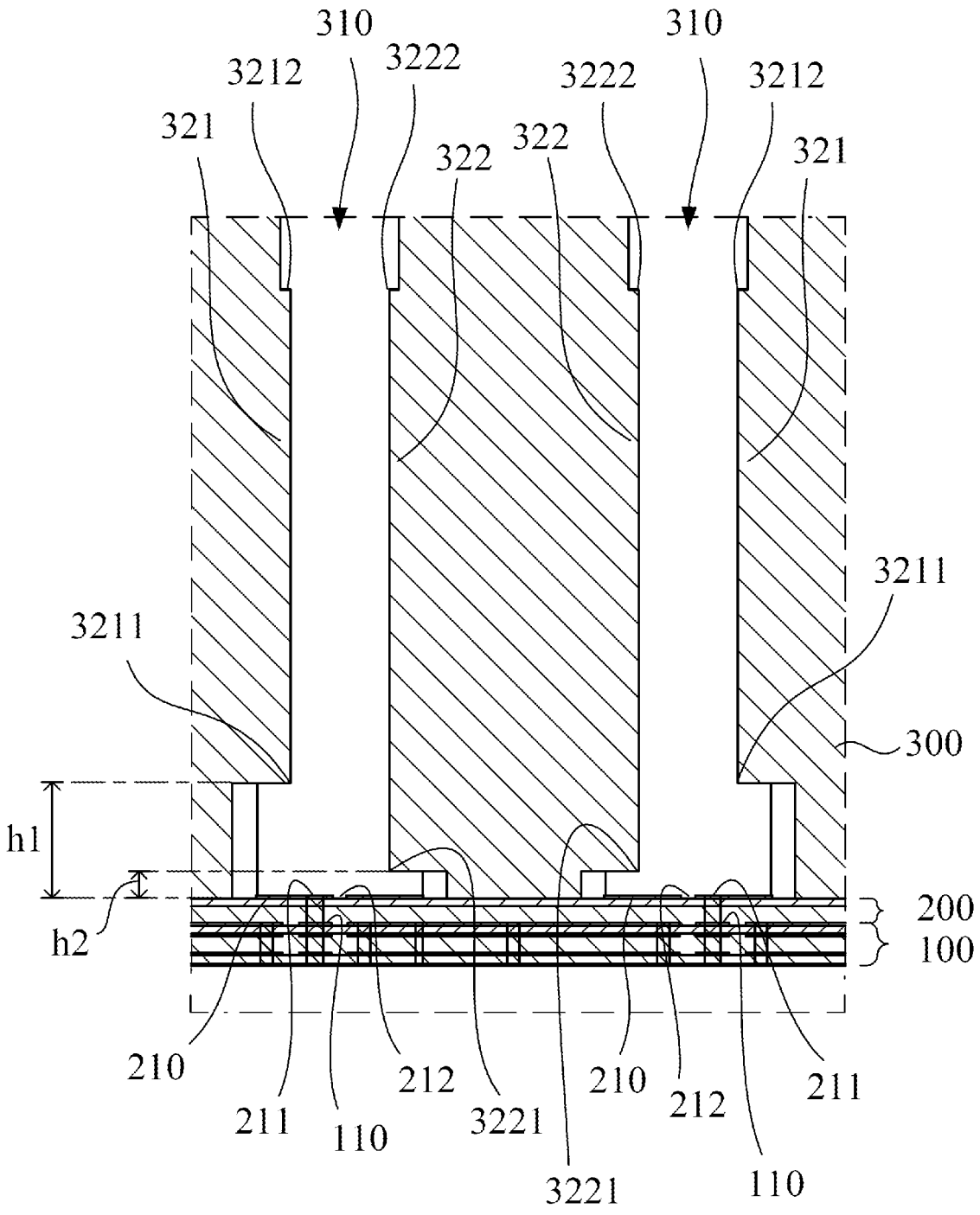
FIG. 4 is a partial three-dimensional section schematic diagram along a section line AA' in FIG. 2.

Referring to FIG. 3 and FIG. 4, FIG. 4 shows a partial three-dimensional section schematic diagram along the section line AA' in FIG. 2. The first lower withdrawn edge 3211 is a position at which withdrawal toward the wall surface of waveguide channel 310 begins, and thus the first lower withdrawn edge 3211 is distanced from the antenna array substrate 200 by a first matching height h1, as shown in FIG. 4. The second lower withdrawn edge 3221 is a position at which withdrawal towards the wall surface of the waveguide channel 310 begins, and thus the second lower withdrawn edge 3221 is distanced from the antenna array substrate 200 by a second matching height 2, as shown in FIG. 4. The configuration of the first matching height h1 and the second matching height h2 provides the electromagnetic waves emitted from the antenna substrate with different adjustment levels on the side of the first ridge 321 and the side of the second ridge 322, further achieving waveguide matching and expanded bandwidths at the same time.

Therefore, with the configuration of the first matching height h1 different from the second matching height h2, an impedance matching capability is provided when the electromagnetic waves are fed into the waveguide channel 310. Further, when the first ridge 321 is closer to the coupling portion 211 than the second ridge 322, the first matching height h1 is more than the second matching height h2, which offers even better impedance matching effects.

In the example shown in FIG. 3 and FIG. 4, the coupling portion 211 may be formed of a conductive material disposed in a through hole of the antenna array substrate 200. On a bottom surface of the antenna array substrate 200, the coupling portion 211 is further coupled to a signal feed portion 110 of the signal processing substrate 100 to form a signal transmission path, for example, forming a conductive column shown in FIG. 4. Moreover, the impedance matching portion 212 is formed by a matching hole that passes through the antenna unit 210. Moreover, the impedance matching portion 212 is closer to the middle part of the antenna unit 210 than the coupling portion 211. In other words, the position of the signal feed point (for feeding to the waveguide channel 310) on the antenna unit 210 is closer to the first ridge 321 compared to the second ridge 322.

Referring to FIG. 1, FIG. 3 and FIG. 4, the antenna unit 210 may be a conductive sheet, for example, a sheet in a copper foil formed by plating of a copper material during the manufacturing process of a printed circuit board. The impedance matching portion 212 may be configured at the center of the conductive sheet. Further, two neighboring ridges between two neighboring waveguide channels may be the same first ridge 321 or the same second ridge 322. An example of the same second ridge 322 is given in FIG. 4, thus further improving the isolation effects between individual signals to prevent interference. In addition, the coupling portion 211 and the impedance matching portion 212 may also be correspondingly arranged.

For example, when the wavelength of electromagnetic waves to be transmitted enters a millimeter range, a gap of 0.5λ is usually needed between individual antenna units in an antenna array to prevent grating lobes from occurring, and correspondingly, neighboring waveguide channels need to be configured more closely, further leading to higher difficulties in the antenna design. However, with the coordination of the ridges and matching heights in the embodiments of the present invention, the configuration requirement of such close gaps is fulfilled, and signal transmission quality is enhanced at the same time.

Referring to FIG. 3 and FIG. 4, the first ridge 321 may have a first upper withdrawn edge 3212 on an upper section of the waveguide channel 310, and the second ridge 322 may have a second upper withdrawn edge 3222 on the upper section of the waveguide channel 310. In other words, as getting closer to an emission exit of the waveguide channel 310, the channel width defined by the two ridges gradually increases to provide a matching effect as electromagnetic waves are about to enter the air.

Figure 5:
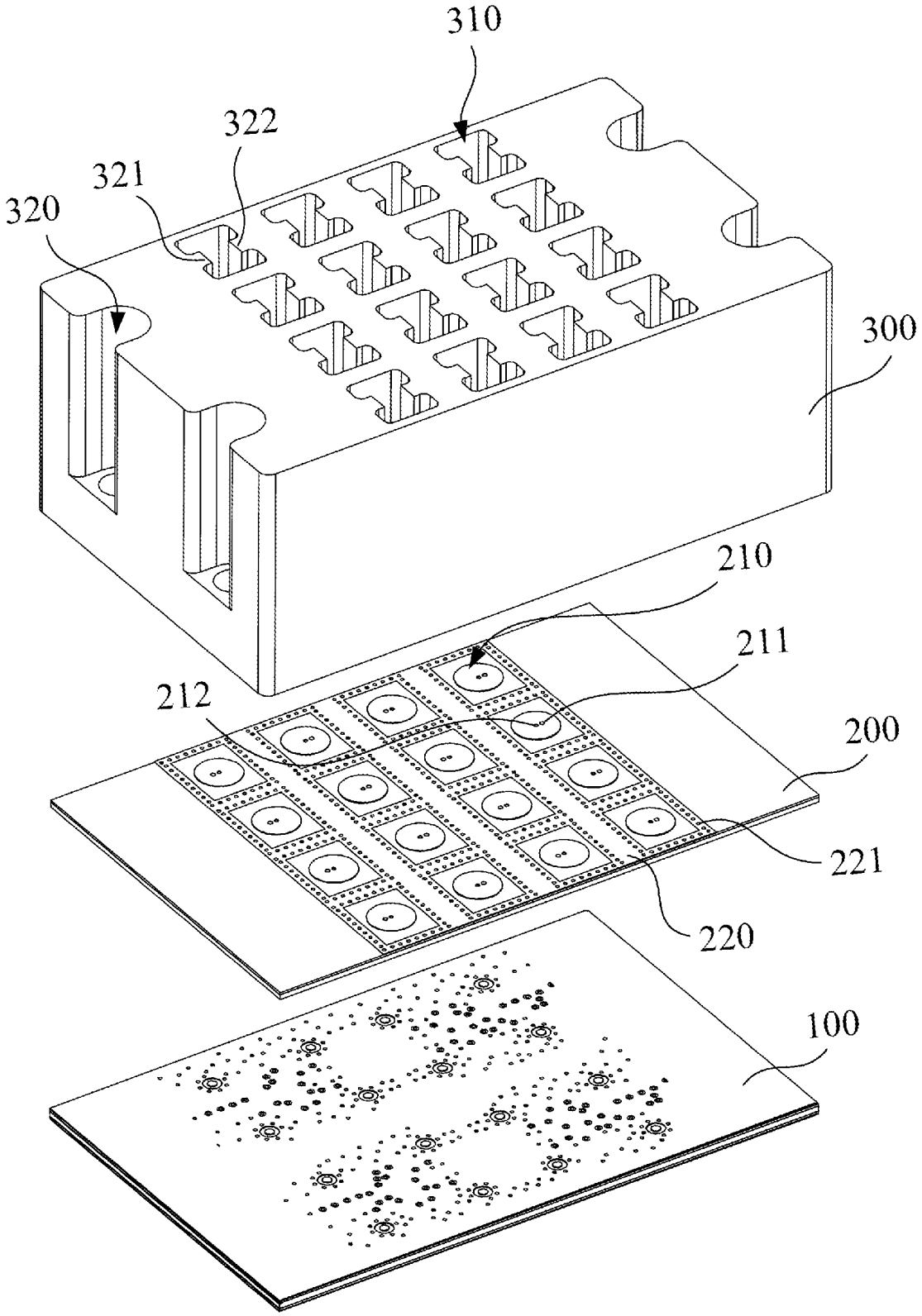
FIG. 5 is an exploded schematic diagram of a new single polarized array waveguide antenna and a signal processing substrate according to another embodiment of the present invention.

FIG. 5 shows an exploded schematic diagram of a new single polarized array waveguide antenna and a signal processing substrate according to another embodiment of the present invention. Compared to the embodiments in FIG. 1 to FIG. 4, the antenna array substrate 200 of this embodiment further includes a heat dissipation lattice layer 220. The heat dissipation lattice layer 200 may be configured as surrounding each or some of the antenna units 210.

The antenna array substrate 200 may be configured therein with a plurality of heat conducting units 221 passing through the antenna array substrate 200. These heat conducting units 221 may be coupled to a grounding layer of the signal processing substrate 100. Because conductive grounding paths included are established by a metal material and the metal material is also heat conductive, the heat conducting units 221 may accordingly achieve heat conduction effects, so as to provide the antenna array in a dense arrangement with a better heat dissipation solution. The heat conducting units 221 may also be formed of a metal material, such that manufacturing of the heat conducting units 221 may be completed in pre-processed through holes while forming the antenna units 210 during the printed circuit board manufacturing process. The grounding layer in the signal processing substrate 100 is located on a top layer as the example given in FIG. 5 to further enhance an anti-interference capability, and may also be located on other layers in other embodiments.

In conclusion, the novel single polarized array waveguide antenna according to the embodiments of the present invention provides, based on the structural arrangement of the ridges of the waveguide body, better waveguide matching, reduces transmission loss, and facilitates electromagnetic wave energy to be fed from the antenna substrate into the waveguide body and be emitted from the waveguide body, further helping to increase the bandwidth and providing better beamforming effects. Moreover, by using a heat dissipation lattice layer and a plurality of heat conducting units, the antenna array in a dense arrangement is provided with a better heat dissipation solution.

While the invention has been described by means of specific embodiments, numerous modifications and variations could be made thereto by those skilled in the art without departing from the scope and spirit of the invention set forth in the claims.

What is claimed is:

1. A new single polarized array waveguide antenna, configured above a signal processing substrate, comprising:

an antenna array substrate, comprising a plurality of antenna units, each of the antenna units having a coupling portion and an impedance matching portion; and a waveguide body, configured above the antenna array substrate, comprising a plurality of waveguide channels passing through the waveguide body, each of the waveguide channels having a first ridge and a second ridge projecting from wall surfaces and arranged opposite to each other, the first ridge having a first lower withdrawn edge on a lower section of the waveguide channel, the second ridge having a second lower withdrawn edge on the lower section of the waveguide channel, the first lower withdrawn edge being distanced from the antenna array substrate by a first matching height, the second lower withdrawn edge being distanced from the antenna array substrate by a second matching height, the first matching height being different from the second matching height, wherein the first edge is closer to the coupling portion than the second ridge, and the first matching height is more than the second matching height, wherein projecting directions of the first ridge and the second ridge are a polarization direction of electromagnetic waves transmitted, and a position of a signal feed point on the antenna unit is closer to the first ridge with respect to the second ridge.

2. The new single polarized array waveguide antenna according to claim 1, wherein the impedance matching portion is closer to a middle part of the antenna unit than the coupling portion.

3. The new single polarized array waveguide antenna according to claim 2, wherein each of the antenna units is a conductive sheet, and the impedance matching portion is a matching hole passing through the antenna units and is located at a center of the conductive sheet.

4. The new single polarized array waveguide antenna according to claim 3, wherein the coupling portion is a signal feed portion coupled to the signal processing substrate.

5. The new single polarized array waveguide antenna according to claim 1, wherein two neighboring ridges between two neighboring waveguide channels are the same first ridge or the same second ridge.

6. The new single polarized array waveguide antenna according to claim 1, wherein each of the waveguide channels is a rectangle in shape, and each first ridge and each second ridge project from wall surfaces of opposite sides of the rectangle.

7. The new single polarized array waveguide antenna according to claim 1, wherein the first ridge has a first upper withdrawn edge on an upper section of the waveguide channel, and the second ridge has a second withdrawn edge on the upper section of the waveguide channel.

8. The new single polarized array waveguide antenna according to claim 1, wherein the antenna array substrate further comprises a heat dissipation lattice layer, the heat dissipation lattice layer is coupled to a plurality of heat conducting units passing through the antenna array substrates, and each of the heat conducting units is coupled to a grounding layer of the signal processing substrate.

9. The new single polarized array waveguide antenna according to claim 8, wherein each of the antenna units is surrounded by the heat dissipation lattice layer.

10. The new single polarized array waveguide antenna according to claim 8, wherein the waveguide body, the heat dissipation lattice layer and the heat conducting units are formed of metal materials.

* * * * *